US008450875B2

(12) United States Patent
Rossmanith et al.

(10) Patent No.: US 8,450,875 B2
(45) Date of Patent: May 28, 2013

(54) APPARATUS AND METHOD FOR CONTROLLING ELECTRICAL LOADS

(75) Inventors: Thomas Rossmanith, Munich (DE); Maximilian Schmidl, Pullach (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 237 days.

(21) Appl. No.: 12/809,607

(22) PCT Filed: Dec. 21, 2007

(86) PCT No.: PCT/EP2007/064484
§ 371 (c)(1),
(2), (4) Date: Jun. 21, 2010

(87) PCT Pub. No.: WO2009/083025
PCT Pub. Date: Jul. 9, 2009

(65) Prior Publication Data

US 2010/0270944 A1 Oct. 28, 2010

(51) Int. Cl.
*H02J 3/00* (2006.01)
*H02J 1/00* (2006.01)
*H02J 3/14* (2006.01)

(52) U.S. Cl.
USPC ..... 307/38; 307/112; 315/291

(58) Field of Classification Search
USPC ..... 307/38
See application file for complete search history.

(56) References Cited

U.S. PATENT DOCUMENTS 5,237,207 A * 8/1993 Kwiatkowski et al. ..... 307/31
2002/0109465 A1 8/2002 Miyoshi
2005/0083626 A1 4/2005 Bruwer
2008/0042581 A1* 2/2008 Huber ..... 315/158

FOREIGN PATENT DOCUMENTS

WO 2006074630 A1 7/2006

OTHER PUBLICATIONS

International Search Report of PCT/EP2007/064484 dated Nov. 12, 2008.

* cited by examiner

*Primary Examiner* — Stephen W Jackson
*Assistant Examiner* — Toan Vu

(57) ABSTRACT

An apparatus for controlling at least one electrical load may include at least one pushbutton; a communications interface for communicating with the loads, the loads being switched on and off by the at least one pushbutton via the communications interface; and a first controlled switch with control logic, said switch being connected between the loads and a power supply, and the first controlled switch isolates the power supply from the loads as soon as all of the loads have been disconnected via the communications interface.

12 Claims, 10 Drawing Sheets

| No. | 51 | a | b | c | d | e | 550 (n-1) | g | f | 550 | 530 |
|---|---|---|---|---|---|---|---|---|---|---|---|
| 1 | 1 | 0 | 0 | 0 | 0 | 0 | 0 | 0 | 1 | 1 | 0 |
| 2 | 0 | x | 1 | x | x | x | 1 | 0 | 1 | 1 | 1 |
| 3 | 0 | 0 | 0 | 1 | 0 | 0 | 1 | 1 | 0 | 1 | 0 |
| 4 | | x | 1 | x | x | x | 1 | 1 | 0 | 1 | 1 |
| 5 | | 0 | 0 | 1 | 0 | 0 | 1 | 0 | 0 | 0 | 0 |

FIG 7b

| | 51 | a | b | c | d | e | α | f | g | 550 | 530 |
|---|---|---|---|---|---|---|---|---|---|---|---|
| 1 | 0 | 0 | 0 | 0 | 0 | 0 | 0 | 1 | 0 | 1 | 0 |
| 2 | 1 | 0 | 0 | 0 | 0 | 0 | 0 | 1 | 0 | 1 | 0 |
| 3 | 0 | 1 | 0 | 0 | 0 | 0 | 0 | 1 | 0 | 1 | 0 |
| 4 | 0 | 0 | 1 | 0 | 0 | 0 | 0 | 1 | 0 | 1 | 1 |
| 5 | 0 | 0 | 0 | 1 | 0 | 0 | 1 | 1 | 1 | 1 | 0 |
| 6 | 0 | 0 | 0 | 0 | 1 | 0 | 0 | 0 | 1 | 1 | 0 |
| 7 | 0 | 0 | 0 | 0 | 0 | 1 | 0 | 0 | 1 | 1 | 0 |
| 8 | 0 | 0 | 0 | 0 | 0 | 0 | 0 | 0 | 1 | 1 | 0 |
| 9 | 1 | 0 | 0 | 0 | 0 | 0 | 0 | 0 | 1 | 1 | 0 |
| 10 | 1 | 1 | 0 | 0 | 0 | 0 | 0 | 0 | 1 | 1 | 0 |
| 11 | 1 | 1 | 1 | 0 | 0 | 0 | 0 | 0 | 1 | 1 | 1 |
| 12 | 1 | 1 | 1 | 1 | 0 | 0 | 0 | 0 | 1 | 1 | 1 |
| 13 | 0 | 1 | 1 | 1 | 1 | 0 | 0 | 0 | 1 | 1 | 1 |
| 14 | 0 | 0 | 1 | 1 | 1 | 1 | 0 | 0 | 1 | 1 | 1 |
| 15 | 0 | 0 | 0 | 1 | 1 | 1 | 0 | 0 | 1 | 1 | 0 |
| 16 | 0 | 0 | 0 | 0 | 1 | 1 | 0 | 0 | 1 | 1 | 0 |
| 17 | 0 | 0 | 0 | 0 | 0 | 1 | 0 | 0 | 1 | 1 | 0 |
| 18 | 0 | 0 | 0 | 0 | 0 | 0 | 0 | 0 | 1 | 1 | 0 |
| 19 | 1 | 0 | 0 | 0 | 0 | 0 | 0 | 0 | 1 | 1 | 0 |
| 20 | 0 | 1 | 0 | 0 | 0 | 0 | 0 | 0 | 1 | 1 | 0 |
| 21 | 1 | 0 | 1 | 0 | 0 | 0 | 0 | 0 | 1 | 1 | 1 |
| 22 | 0 | 1 | 0 | 1 | 0 | 0 | 0 | 0 | 1 | 1 | 0 |
| 23 | 0 | 0 | 1 | 0 | 1 | 0 | 0 | 0 | 1 | 1 | 1 |
| 24 | 0 | 0 | 0 | 1 | 0 | 1 | 0 | 0 | 1 | 1 | 0 |
| 25 | 0 | 0 | 0 | 0 | 1 | 0 | 0 | 0 | 1 | 1 | 0 |
| 26 | 0 | 0 | 0 | 0 | 0 | 1 | 0 | 0 | 1 | 1 | 0 |
| 27 | 0 | 0 | 0 | 0 | 0 | 0 | 0 | 0 | 1 | 1 | 0 |
| 28 | 1 | 0 | 0 | 0 | 0 | 0 | 0 | 0 | 1 | 1 | 0 |
| 29 | 0 | 1 | 0 | 0 | 0 | 0 | 0 | 0 | 1 | 1 | 0 |
| 30 | 0 | 0 | 1 | 0 | 0 | 0 | 0 | 0 | 1 | 1 | 1 |
| 31 | 0 | 0 | 0 | 1 | 0 | 0 | 1 | 0 | 0 | 0 | 0 |
| 32 | 0 | 0 | 0 | 0 | 1 | 0 | 0 | 0 | 0 | 0 | 0 |
| 33 | 0 | 0 | 0 | 0 | 0 | 1 | 0 | 0 | 0 | 0 | 0 |
| 34 | 0 | 0 | 0 | 0 | 0 | 0 | 0 | 0 | 0 | 0 | 0 |

| | 51 | a | b | c | d | e | α | f | g | 550 | 530 |
|---|---|---|---|---|---|---|---|---|---|---|---|
| 35 | 0 | 0 | 0 | 0 | 0 | 0 | 0 | 1 | 0 | 1 | 0 |
| 36 | 1 | 0 | 0 | 0 | 0 | 0 | 0 | 1 | 0 | 1 | 0 |
| 37 | 1 | 1 | 0 | 0 | 0 | 0 | 0 | 1 | 0 | 1 | 0 |
| 38 | 1 | 1 | 1 | 0 | 0 | 0 | 0 | 1 | 0 | 1 | 1 |
| 39 | 1 | 1 | 1 | 1 | 0 | 0 | 0 | 1 | 0 | 1 | 1 |
| 40 | 0 | 1 | 1 | 1 | 1 | 0 | 0 | 1 | 1 | 1 | 1 |
| 41 | 0 | 0 | 1 | 1 | 1 | 1 | 0 | 0 | 1 | 1 | 1 |
| 42 | 0 | 0 | 0 | 1 | 1 | 1 | 0 | 0 | 1 | 1 | 0 |
| 43 | 0 | 0 | 0 | 0 | 1 | 1 | 0 | 0 | 1 | 1 | 0 |
| 44 | 0 | 0 | 0 | 0 | 0 | 1 | 0 | 0 | 1 | 1 | 0 |
| 45 | 0 | 0 | 0 | 0 | 0 | 0 | 0 | 0 | 1 | 1 | 0 |
| 46 | 1 | 0 | 0 | 0 | 0 | 0 | 0 | 0 | 1 | 1 | 0 |
| 47 | 0 | 1 | 0 | 0 | 0 | 0 | 0 | 0 | 1 | 1 | 0 |
| 48 | 1 | 0 | 1 | 0 | 0 | 0 | 0 | 0 | 1 | 1 | 1 |
| 49 | 0 | 1 | 0 | 1 | 0 | 0 | 0 | 0 | 1 | 1 | 0 |
| 50 | 0 | 0 | 1 | 0 | 1 | 0 | 0 | 0 | 1 | 1 | 1 |
| 51 | 0 | 0 | 0 | 1 | 0 | 1 | 0 | 0 | 1 | 1 | 0 |
| 52 | 0 | 0 | 0 | 0 | 1 | 0 | 0 | 0 | 1 | 1 | 0 |
| 53 | 1 | 0 | 0 | 0 | 0 | 1 | 0 | 0 | 1 | 1 | 0 |
| 54 | 0 | 0 | 0 | 0 | 0 | 0 | 0 | 0 | 1 | 1 | 0 |
| 55 | 1 | 0 | 0 | 0 | 0 | 0 | 0 | 0 | 1 | 1 | 0 |
| 56 | 0 | 1 | 0 | 0 | 0 | 0 | 0 | 0 | 1 | 1 | 0 |
| 57 | 0 | 0 | 1 | 0 | 0 | 0 | 0 | 0 | 1 | 1 | 1 |
| 58 | 0 | 0 | 0 | 1 | 0 | 0 | 1 | 0 | 0 | 0 | 0 |
| 59 | 0 | 0 | 0 | 0 | 1 | 0 | 0 | 0 | 0 | 0 | 0 |
| 60 | 0 | 0 | 0 | 0 | 0 | 1 | 0 | 0 | 0 | 0 | 0 |
| 61 | 0 | 0 | 0 | 0 | 0 | 0 | 0 | 0 | 0 | 0 | 0 |
| 62 | 0 | 0 | 0 | 0 | 0 | 0 | 0 | 0 | 0 | 0 | 0 |

FIG 12

APPARATUS AND METHOD FOR CONTROLLING ELECTRICAL LOADS

RELATED APPLICATIONS

The present application is a national stage entry according to 35 U.S.C. §371 of PCT application No.: PCT/EP2007/064484 filed on Dec. 21, 2007.

TECHNICAL FIELD

The invention relates to an apparatus for controlling at least one electrical load, with at least one pushbutton, and a communications interface for communicating with the loads, the loads being switched on and off by the at least one pushbutton via the communications interface.

BACKGROUND

Various embodiments are based on an apparatus for controlling at least one electrical load.

FIG. 10 shows a conventional installation of loads, in this case electronic control gear for light-emitting means in accordance with the prior art. The electronic control gear are connected to a power supply (N, PE) and are switched on and off via a communications interface (DA). A conventional protocol in this sector is the DALI (Digital Addressable Lighting Interface) protocol. A preferred functionality of the communications interface in relatively small installations is the so-called touch-dim function, which is also controlled by many devices with a DALI interface. A pushbutton is used for this purpose. If the pushbutton is depressed for only a short period of time, the control gear switches the one or more light-emitting means on or off. If the pushbutton is depressed for a relatively long period of time when the light-emitting means are switched on, the light-emitting means are faded up or down. In the case of both a short depression and a relatively long depression of the pushbutton, the function which is respectively complementary to the preceding function is implemented. If the light-emitting means are in operation, they are switched off by a short depression of the pushbutton. If they are switched off, they are switched on by a short depression of the pushbutton and so on. If the light-emitting means are switched on and the pushbutton is depressed for a relatively long period of time, the light-emitting means are faded down. In the case of the next relatively long depression of the pushbutton they are faded up again. The present dimming position can be stored in the device by a "double click", i.e. two depressions of the pushbutton in quick succession.

The switching-on and switching-off operations can take place at any desired point in time, as can other DALI/touch-dim commands, which means that the electronic control gear need to be constantly communications-ready. The electronic control gear therefore need to have a constant supply of power. This applies in particular also when the light-emitting means of an electronic control gear has been switched off by a DALI/touch-dim command and is in the standby mode.

The above described permanent power supply to electronic control gear results in a high level of undesired power consumption in the standby mode, in particular in the case of large lighting installations.

Relatively large lighting installations are isolated from the power supply system manually or via timer switches in order to reduce the power consumption in the standby mode when it is ensured that they are not required (for example at night). During conventional use times of the installation, however, all of the parts of the installation are supplied with power from the power supply system. Unused parts of the installation are then in the standby operating mode and thus cause an undesirable additional power consumption.

Isolating the lighting installation from the power supply system manually or in a controlled manner via timer switches, as has previously been the practice, in order to save energy also has the disadvantage that the lighting installation can only be activated by additional working steps, if said lighting installation is required during this time as an exception.

SUMMARY

Various embodiments specify an apparatus which controls the loads in such a way that the standby losses are reduced.

Various embodiments further specify a method by means of which one or more loads can be controlled in such a way that the standby losses of the loads are reduced.

In various embodiments, the pushbutton which controls the loads is extended by control logic and a first controlled switch. This first controlled switch is connected between the power supply and the loads. It preferably switches the phase of the power supply. A second controlled switch serves the purpose of passing the pulse sequences generated by the pushbutton onto the loads via an output of the apparatus. The control logic knows the switching states of the loads and identifies specific switching operations. If the loads are switched on, and the pushbutton is depressed for a short period of time, the loads are switched off via the communications interface, and the controlled switch is then opened for a short period of time in order to isolate the power supply from the loads and from the control logic of the controlled switch. If the pushbutton is depressed again, the controlled switch is closed and the power supply is applied to the control logic and to the loads. Shortly after this, the switch-on signal generated by the pushbutton is passed on by the second controlled switch in order to switch on the loads. All of the other operations which relate to the touch-dim functionality are sassed on directly from the pushbutton to the loads by the second controlled switch.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

Figure 7A:
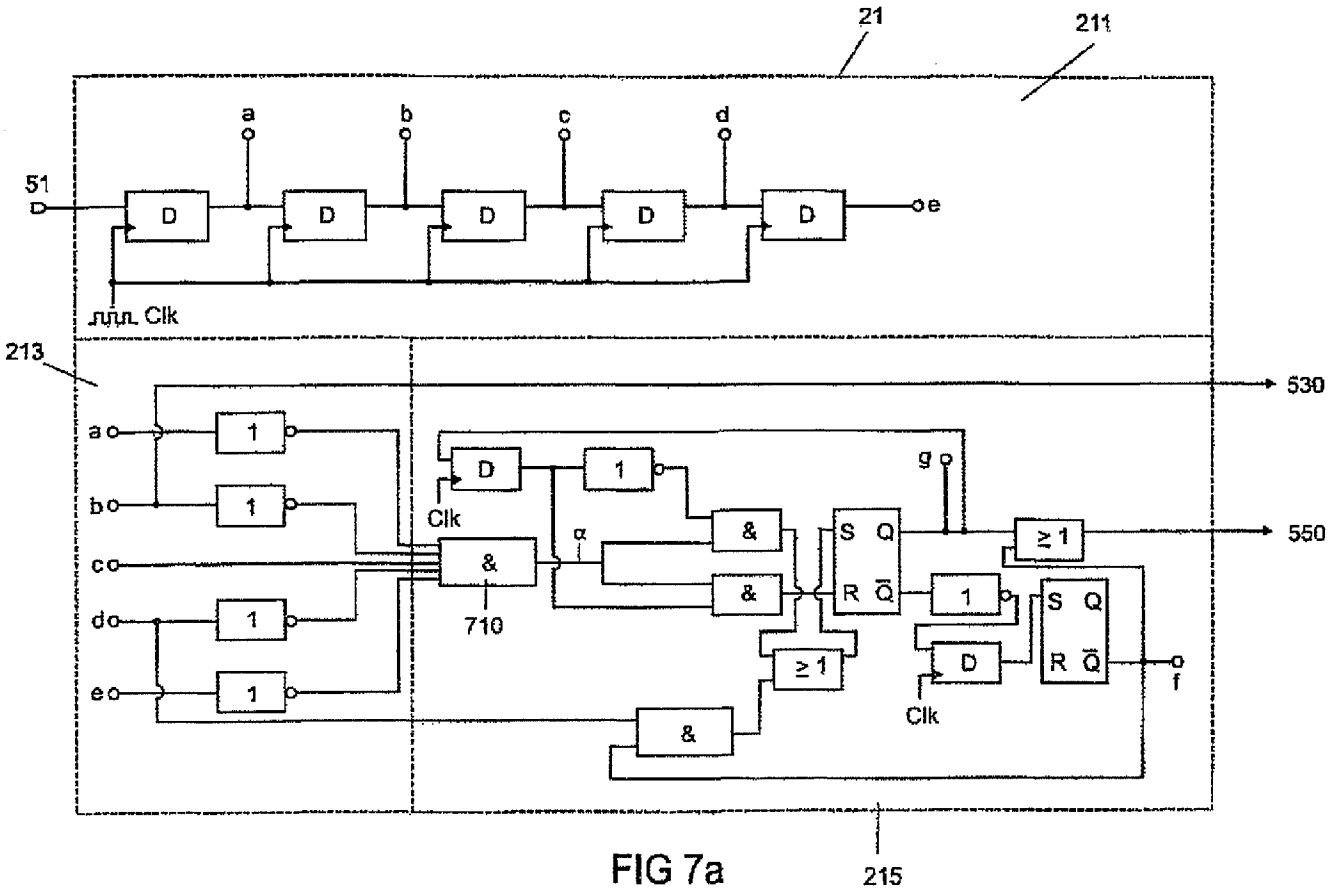

FIG. 7*a* shows an illustration of the circuitry for analog control logic of the apparatus according to the invention.

FIG. 7*b* shows a state table for the analog control logic of the apparatus according to the invention.

FIG. 8 shows an illustration of the driving of the controlled switches of the apparatus according to the invention.

Figure 9:
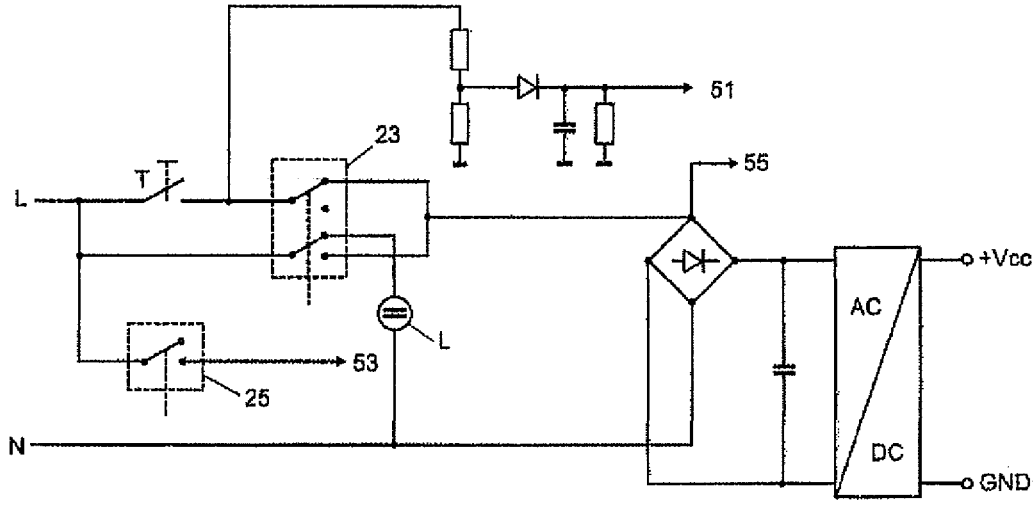

FIG. 9 shows a circuit arrangement of the power section in a further variant of the apparatus according to the invention.

Figure 10:
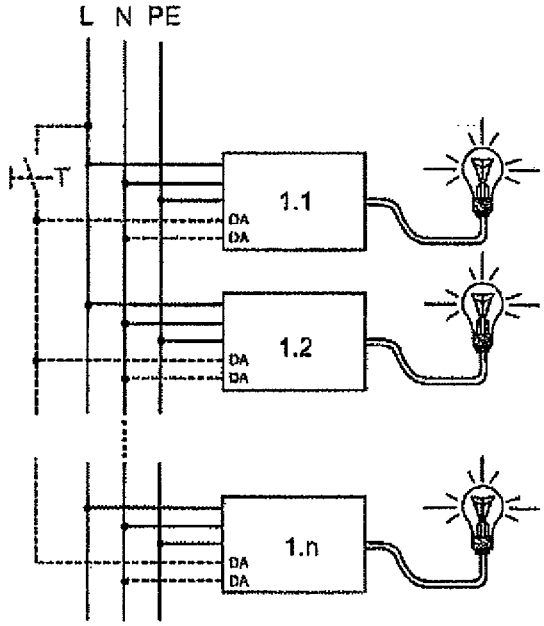
FIG 10 (Prior art)

FIG. 10 shows an installation for controlling loads in accordance with the prior art.

Figure 6:
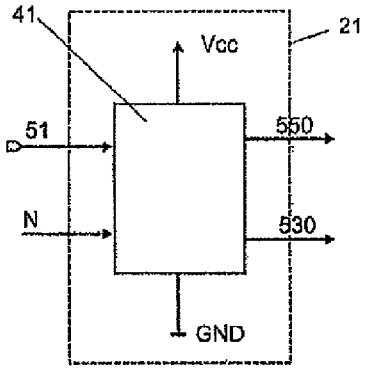
FIG. 6 shows a schematic illustration of a digital control logic with a microcontroller of the apparatus according to the invention.
Figure 11:
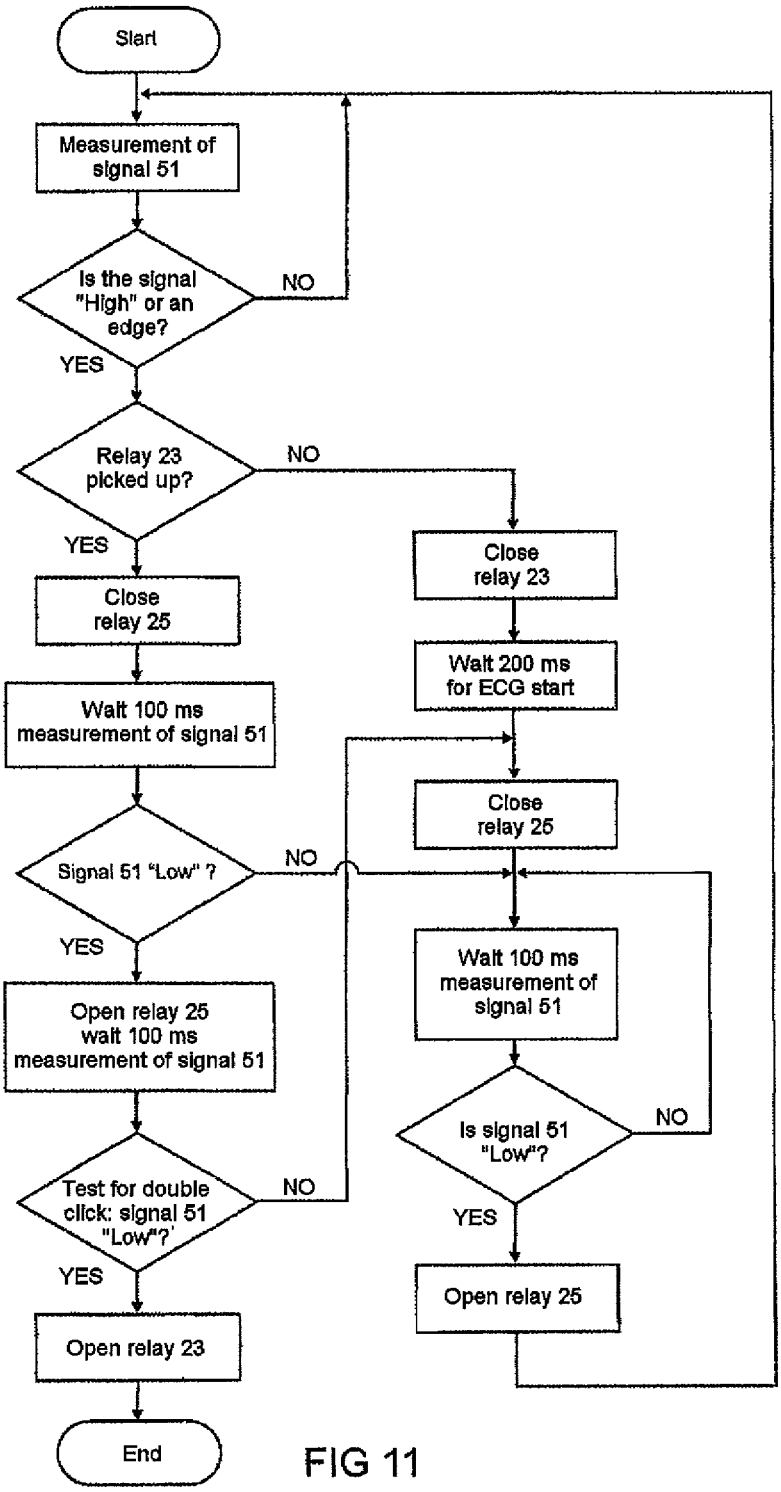

FIG. 11 shows a flow chart for illustrating the internal functional sequences in the digital control logic shown in FIG. 6.

FIG. 12 shows a sequence diagram with the exemplary illustration of a plurality of operations and the associated signals.

DETAILED DESCRIPTION

The following detailed description refers to the accompanying drawings that show, by way of illustration, specific details and embodiments in which the invention may be practiced.

Figure 1:
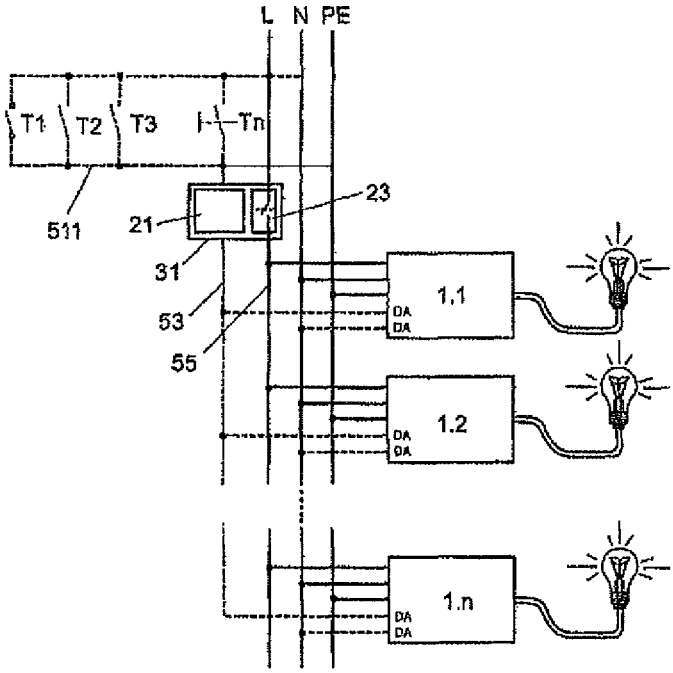
FIG. 1 shows an installation with the apparatus according to the invention in a first embodiment for supplying power to loads.

A first embodiment 31 of the apparatus according to the invention is shown in FIG. 1. The loads 1.1, 1.2, . . . , 1.*n* are all connected to a power supply system, which has a looped-through neutral conductor N and a looped-through ground conductor PE. The phase 55 is switched by the first controlled switch 23. The first controlled switch is driven by control logic 21. The apparatus according to the invention has an input for one or more pushbuttons $T_1$-$T_n$, which are each connected in parallel. The pushbutton(s) $T_1$-$T_n$ generate an input signal 511. The loads 1.1, 1.2, . . . , 1.*n* are controlled via the pushbutton(s) $T_1$-$T_n$ preferably by means of the touch-dim method mentioned at the outset.

Figure 2:
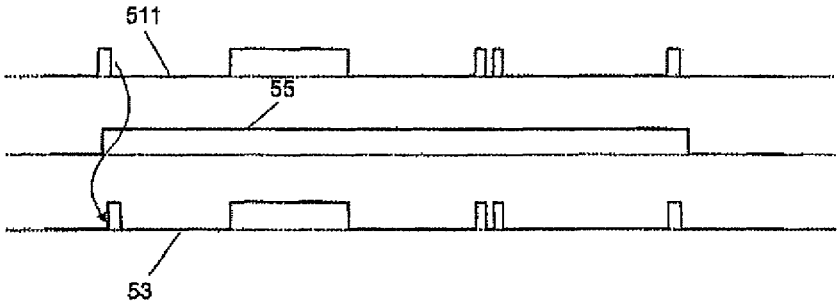
FIG. 2 shows some relevant signals of the apparatus according to the invention.

FIG. 2 illustrates some signals which relate to the apparatus according to the invention. Signal 511 is the input signal generated by the pushbuttons $T_1$-$T_n$. The control logic identifies that a pushbutton has been depressed once and switches on the first controlled switch 23 in order to apply the power supply, illustrated by the signal 55, to the loads. Shortly after the power supply has been switched on (approximately 200 ms), the switch-on signal is reproduced at the control output (signal 53). As long as the loads are switched on, all of the operations which are generated by one of the pushbuttons $T_1$-$T_n$ are looped through or reproduced with a delay. Only a single depression of the pushbutton is identified by the control logic, and thereupon the loads are switched off and then the power supply is isolated by opening the first controlled switch 23.

Figure 3:
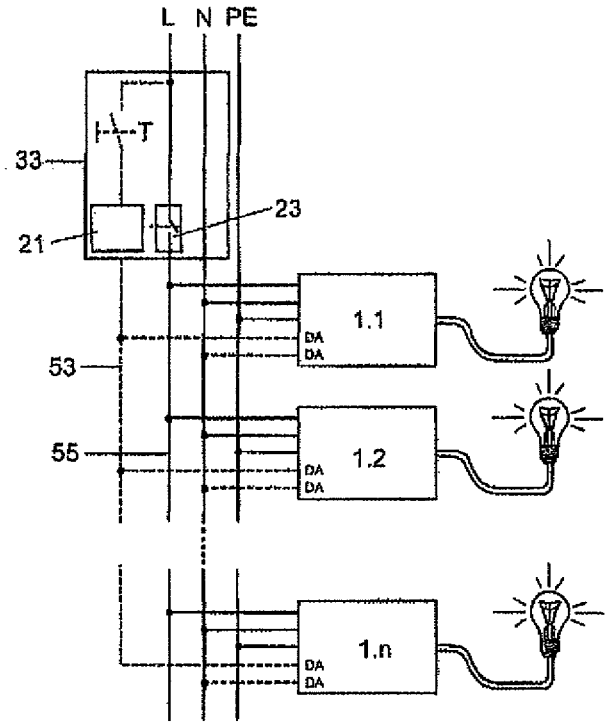
FIG. 3 shows an installation with the apparatus according to the invention in a second exemplary embodiment for supplying power to loads.
Figure 4:
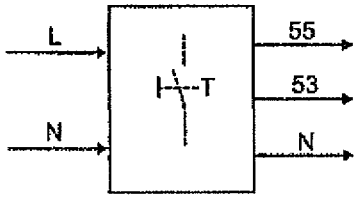
FIG. 4 shows the assignment of the terminals of the apparatus according to the invention in the second embodiment.

In a second embodiment shown in FIG. 3, the apparatus according to the invention is provided as an integrated solution 33 for installation in a flush-mounted box, for example. A pushbutton T is integrated in the apparatus which has the assignment of terminals illustrated in FIG. 4. The apparatus contains a system phase L and a neutral conductor N as inputs. Alternatively, an input for connection of further pushbuttons can be provided. The neutral conductor N is looped through and forms, together with the switched phase 55, the switching output. The signal 53 forms, together with the neutral conductor N, the output of the communications interface for controlling the loads.

Figure 5:
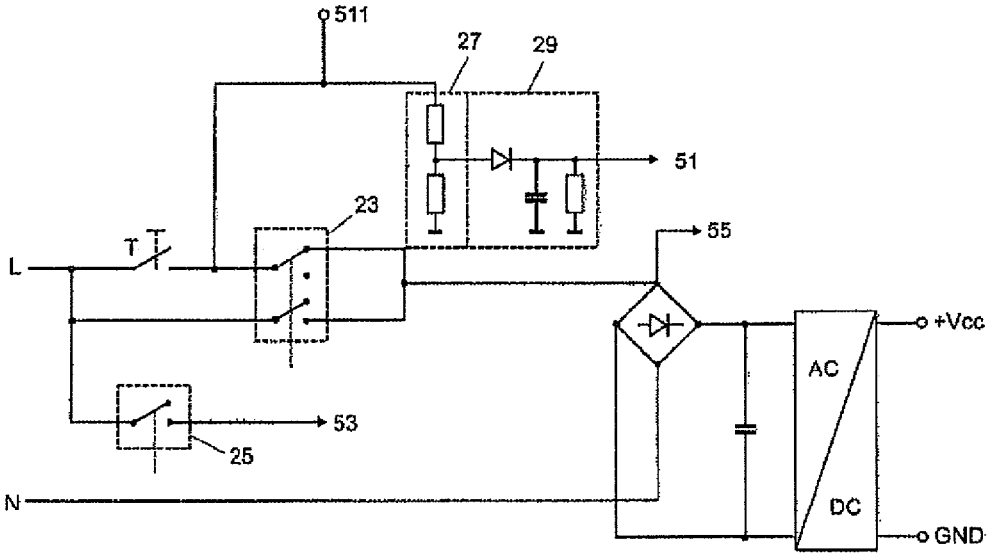
FIG. 5 shows a circuit arrangement of the power section of the apparatus according to the invention.

FIG. 5 illustrates the circuit arrangement of the power section of the apparatus according to the invention. A pushbutton T, which forms the signal 511, is connected to the phase L. This signal is converted into a low-voltage signal 51 via a voltage divider 27 and an interference suppression stage 29 for further-processing in the control logic 21. The first controlled switch 23, which is in this case in the form of a relay, is arranged downstream of the pushbutton T. At the output of the switch 23, the signal 55 is present in the form of a switching signal. A low-voltage signal for supplying the control logic is generated via a bridge rectifier and a step-down converter from the signal 55. The control signal 53 for the communications interface is generated by a second switch 25 controlled by the control logic.

FIG. 6 shows a schematic illustration of digital control logic 21 with a microcontroller 41 of the apparatus according to the invention. The microcontroller processes the input signal 51 and, independently of the input signal 51, provides the two output signals 550 and 530 for driving the first and second control switch. The logic itself is implemented using the corresponding software. An overview of the basic functionality of the software is shown in FIG. 11. Essentially the states of the two relays 23 and 25 are interrogated and a distinction is drawn between a single depression of the pushbutton T and a "double click". In the case of a single depression of the pushbutton, this signal is passed onto the second controlled switch 25 and output as signal 53 if the loads 1.1, 1.2, . . . , 1.*n* are switched on. Then, the loads 1.1, 1.2, . . . , 1.*n* are switched off by means of the first controlled switch 23. If the loads are switched off, they are only switched on by means of the first controlled switch 23 and the signal with the switch-on pulse is then subsequently output as signal 53.

Figure 8A:
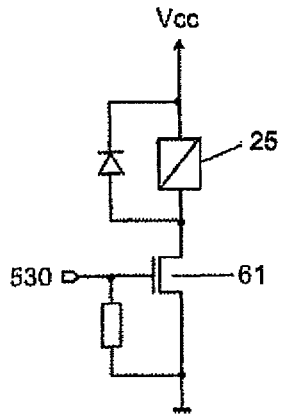
Figure 8B:
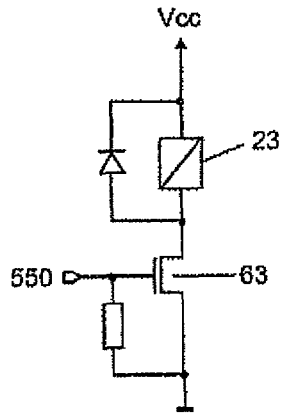

The expression "open/close relays 23/25" is in this case always intended to mean the output of a corresponding signal 550/530 at the output of the digital circuit. The driving of the first and second controlled switches is implemented via transistors 63 and 61, respectively, and is illustrated in FIGS. 8*a* and 8*b*. The control signals 530 and 550 are input into the transistors 61 and 63, respectively, and said transistors then correspondingly switch the controlled switches 25 and 23, respectively.

FIG. 7*a* shows a schematic illustration of analog control logic 21, which includes various logic gates and flip-flops. The associated state table for the logic is illustrated in FIG. 7*b*. This table applies in principle also to digital control logic as shown in FIG. 6. The procedure for the analog control logic is as follows: the input signal 51 of the pushbutton is converted in a pulse shaping unit 211 to form a time-discrete pulse train, is then sampled in a detection unit 213 with respect to a single depression of the pushbutton and then the two control signals 530 and 550 are generated on the basis of this information in a logic switching unit 215.

FIG. 12 depicts an exemplary sequence of a few relevant signals. The figure shows the input signal 51 generated by the pushbutton T and the time-discrete signals a, b, c, d and e. As intermediate signal, the output signal a of the AND gate 710 is specified, as well as the signals f and g. Finally, the signals 530 and 550 are specified.

FIG. 12 represents a time-discrete sequence of 62 cycles of the analog control logic with different exemplary depressions of the pushbutton. The cycle numbers are specified in the first column. The function "switch on" i.e. a single depression of the pushbutton, is indicated in cycle 1-8. Cycle 9-18 shows, by way of example, the function "dimming", i.e. a relatively long depression of the pushbutton by means of which the loads 1.1, 1.2, . . . , 1.*n* are dimmed. The function "double click" for storing the dimming level can be followed in cycles 19-27. The subsequent switching-off of the loads 1.1, 1.2, . . . , 1.*n* is indicated in cycles 28-34. The touch-dim functionality "switch on with immediate dimming", i.e. a long depression of the pushbutton when the loads 1.1, 1.2, . . . , 1.*n* are switched off, can be followed in cycles 35-45. Cycles 46-54 in turn describe the storing of the dimming level, i.e. a double depression of the pushbutton. Cycles 55-62 finally switch the loads 1.1, 1.2, . . . , **1.*n*** off again.

In this table, it is possible to follow how a "double click" is intercepted and passed on in signal 53, while a single depression of the pushbutton results in the loads 1.1, 1.2, . . . , **1.*n*** being switched on or off, the hardware-side switching-on or switching-off of the loads correspondingly taking place in advance or subsequently.

FIG. 9 shows a variant of the second embodiment with the additional feature of an illuminated pushbutton which only illuminates if all of the loads are disconnected. For this purpose, a switching contact of the first controlled switch is used, which switching contact connects the pushbutton illumination L to the power supply if the loads are isolated from the power supply.

FIG. 10 shows the installation described at the outset for controlling loads in accordance with the prior art.

With the method according to the invention and the apparatus according to the invention it is possible to save a large amount of energy during operation of, for example, small to medium-sized lighting installations by virtue of the control gear and the apparatus according to the invention itself being isolated from the power supply system when the light-emitting means are disconnected. The control gear and the apparatus according to the invention are only connected to the power supply system again and then available with their full functionality if required.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

| | |
|---|---|
| 1.1 . . . 1.n | Loads 1 . . . n |
| 21 | Control logic |
| 211 | Pulse shaping unit |
| 213 | Detection unit |
| 215 | Logic switching unit |
| 23 | First controlled switch |
| 25 | Second controlled switch |
| 27 | Voltage divider |
| 29 | Interference suppression circuit |
| 31 | Apparatus according to the invention for controlling the power supply to electrical loads |
| 41 | Microcontroller |
| 51 | Low-voltage input switching signal |
| 511 | Input switching signal |
| 53 | Control signal for communications interface |
| 55 | Switching signal for power supply |
| 530 | Control signal for second controlled switch |
| 550 | Control signal for first controlled switch |
| 61 | Drive transistor for second controlled switch |
| 63 | Drive transistor for first controlled switch |
| 710 | AND gates |
| T, $T_1$ . . . $T_n$ | Pushbutton for driving loads |
| L | Phase of power supply |
| N | Neutral conductor of power supply |
| PE | Ground of power supply |
| $V_{cc}$ | Low-voltage supply of control logic |
| GND | Ground of control logic |
| Clk | Clock signal |

The invention claimed is:

1. An apparatus for controlling at least one electrical load, the apparatus comprising:

at least one pushbutton;

a communications interface for communicating with the loads;

a control logic and at least one first controlled switch;

wherein the at least one controlled switch and the communication interface are driven by the control logic;

wherein the control logic includes an input for an input signal;

wherein the at least one pushbutton generates the input signal for the control logic, and wherein the loads are switched on and off by the input signal generated from the at least one pushbutton via the communications interface;

wherein the at least one first controlled switch is connected between the loads and a power supply, and wherein the load is supplied with voltage through the generated input signal of the at least one pushbutton via the control logic through the at least one controlled switch, the first controlled switch, when the load is switched off, isolates the power supply from the loads as soon as all of the loads have been disconnected via the communications interface, and the first controlled switch, when the load is switched on, applies the power supply to the load and the control logic shortly after outputs the input signal as a control signal to the communication interface.

2. The apparatus as claimed in claim 1, wherein the electrical loads are electronic control gear for light sources.

3. The apparatus as claimed in claim 1, wherein the communications interface has a touch-dim functionality.

4. The apparatus as claimed in claim 2, wherein the communications interface corresponds to the Digital Addressable Lighting Interface (DALI) standard with a touch-dim functionality.

5. The apparatus as claimed in claim 1, wherein the control logic has an analog circuit.

6. The apparatus as claimed in claim 1, wherein the control logic has a digital circuit with a micro controller.

7. The apparatus as claimed in claim 1, wherein the apparatus has a second controlled switch, which is driven by the control logic.

8. The apparatus as claimed in claim 7, wherein the second controlled switch reproduces the signal generated by the pushbutton.

9. A method for controlling at least one electrical load, with at least one pushbutton for generating an input signal, at least one controlled switch, a communications interface for communicating with the loads, and a control logic, which drives the at least one controlled switch, the control logic including an input for the input signal generated from the at least one pushbutton, and the loads being configured to be switched on and off by the generated input signal of the at least one pushbutton via the communications interface, wherein the at least one controlled switch is connected between the loads and a power supply, the method comprising:

supplying the loads with voltage through the generated input signal of the at least one pushbutton via the control logic through the at least one controlled switch, disconnecting the loads from the power supply through the at least one controlled switch when the loads are switched on via the communications interface, applying, when the load is switched on, the power supply to the loads through the at least one controlled switch, and outputting the input signal as a control signal shortly after to the communication interface.

10. The apparatus as claimed in claim 8, wherein the second controlled switch reproduces the signal generated by the pushbutton with a delay.

11. The process as claimed in claim 9, wherein the electrical load is configured to be dimmed through the at least one pushbutton via the communication interface.

12. The process as claimed in claim 11, wherein the power supply is switched on before the electrical load is turned on via the communication interface.

* * * * *